US006821356B1

(12) United States Patent
Wandke et al.

(10) Patent No.: US 6,821,356 B1
(45) Date of Patent: Nov. 23, 2004

(54) CLEANING DEVICE AND METHOD FOR CLEANING, USING LIQUID AND/OR SUPERCRITICAL GASES

(75) Inventors: Ernst Wandke, Geretsriod (DE); Reinhard Strigl, München (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/959,939

(22) PCT Filed: May 12, 2000

(86) PCT No.: PCT/EP00/04315

§ 371 (c)(1),
(2), (4) Date: Apr. 23, 2002

(87) PCT Pub. No.: WO00/70140

PCT Pub. Date: Nov. 23, 2000

(30) Foreign Application Priority Data

May 12, 1999 (DE) ..... 199 22 195

(51) Int. Cl.[7] ..... B08B 7/00

(52) U.S. Cl. ..... 134/33; 134/25.1; 134/34; 134/36; 134/120; 134/140; 134/141; 134/157; 68/139; 68/157; 68/175; 68/181; 68/181 R

(58) Field of Search ..... 134/25.1, 33, 34, 134/36, 120, 140, 141, 157; 68/139, 157, 175, 181, 181 R

(56) References Cited

U.S. PATENT DOCUMENTS

| | | | | |
|---|---|---|---|---|
| 3,650,129 A | | 3/1972 | Scroop et al. | |
| 3,961,637 A | | 6/1976 | Owen, Sr | |
| 4,136,537 A | | 1/1979 | Harrsch | |
| 5,669,251 A | | 9/1997 | Townsend et al. | |
| 5,850,747 A | | 12/1998 | Roberts et al. | |
| 6,098,430 A | * | 8/2000 | McClain et al. | 68/18 R |

FOREIGN PATENT DOCUMENTS

| | | |
|---|---|---|
| DE | 42 30 485 A1 | 3/1994 |
| EP | 0 575 005 A1 | 12/1993 |
| WO | 94/01613 | 1/1994 |
| WO | 97/33031 | 9/1997 |
| WO | 99/49122 | 9/1999 |

OTHER PUBLICATIONS

German Search Report, dated Sep. 8, 1999.

* cited by examiner

*Primary Examiner*—Zeinab El-Arini
(74) *Attorney, Agent, or Firm*—Crowell & Moring LLP

(57) ABSTRACT

A cleaning apparatus includes (1) a pressure tank with at least one cleaning tank arranged therein; (2) means for supplying the cleaning apparatus with a cleaning fluid; and (3) means inside the pressure tank for setting the at least one cleaning tank in motion, wherein by these means the at least one cleaning tank is movably arranged relative to the pressure tank in terms of at least one of rotational or translational movement.

34 Claims, 1 Drawing Sheet

Fig.
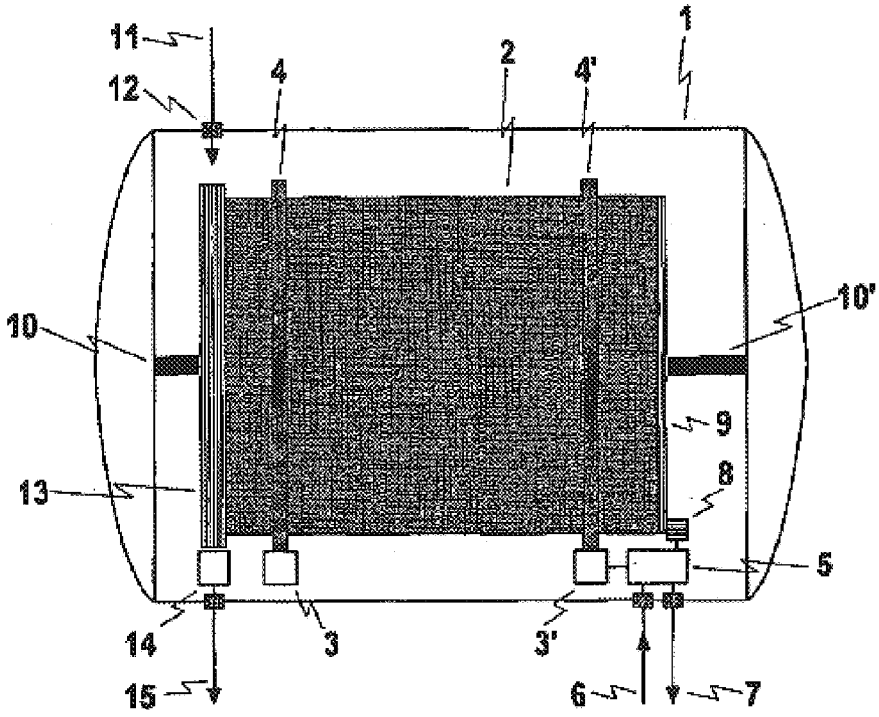

CLEANING DEVICE AND METHOD FOR CLEANING, USING LIQUID AND/OR SUPERCRITICAL GASES

BACKGROUND AND SUMMARY OF INVENTION

The invention relates to a cleaning apparatus that is comprised of (1) a pressure tank with at least one cleaning tank arranged therein, in which the cleaning is performed, and (2) means for supplying the cleaning apparatus with a cleaning fluid. In addition, the cleaning tank or tanks are movably arranged in relation to the pressure tank.

The invention further relates to a method for cleaning substrates using liquefied and/or supercritical gases as cleaning fluid in at least one cleaning tank, which is arranged inside a pressure tank. The cleaning tank or tanks is/are moved at least for part of the time during the cleaning process in relation to the pressure tank.

Cleaning devices of this type, which are used, for example, for cleaning processes involving liquid or supercritical carbon dioxide but that may also be used as cleaning fluid in connection with any other materials or components, are generally designed for use with operating pressures of higher than 60 bar. To improve the cleaning result, it is necessary to generate a relative movement between the material being cleaned and the cleaning fluid. This relative movement can be created by using suitable nozzle systems which move the material that is being cleaned around in a cleaning cylinder, while the cleaning cylinder itself is not being moved.

Also known in the art is a process that puts the cleaning cylinder itself in a rotation in order to positively influence the cleaning result by way of the dropping-down [motion] of the material being cleaned. The rotational movement of the cleaning cylinder can be executed in alternating directions of rotation and/or speed of rotation.

If the cleaning system or the cleaning tank is intended to be used for cleaning processes that take place under high pressure, the cleaning cylinder, that is arranged inside the pressure container or the pressure cleaning tank, is driven via an axle or shaft that penetrates through the pressure container, such as is disclosed, for example, in DE-A 42 30 485. However, this configuration requires costly sealing and/or packing systems, because the drive motor is located outside of the pressure tank.

Recent findings have shown that the cleaning efficiency, especially of carbon dioxide, can be improved with higher operating pressures: under consideration are operating pressures of more than 200 bar. But sealing the shaft lead-through becomes more difficult and energy intensive with increasing pressure. Due to the wall thickness of the pressure container, that is necessary for these high pressure levels, it is not possible to realize contact-free transmission via a magnetic coupling.

Known in the art is, for example from WO-A 94/01613 (U.S. Pat. No. 5,267,455), a drive by way of the rotation of a cleaning cylinder, which is magnetically connected with a drive motor, for the cleaning of substrates using liquefied and/or supercritical gases as the cleaning fluid.

However, regardless of the selected pressure level for the cleaning process in the cleaning tank, disadvantages can result if the cleaning cylinder is driven via a magnetic coupling, because the magnetic field influences the cleaning; e.g. by way of contamination that is present in the cleaning fluid and can become concentrated in certain areas of the cleaning tank as a result of the magnetic field.

Therefore, it is the subject-matter of the present invention to describe an apparatus and a method of the type described at the outset that will avoid the above-mentioned disadvantages and provide an improved cleaning system for cleaning at different pressure levels. In particular, moving axles or shafts designed to drive the cleaning tank, penetrating through the pressure tank, are to be eliminated. To be described is an alternative for generating the movement of the cleaning tank using a magnetic coupling.

For the apparatus, this objective is achieved according to the invention by envisioning that the means for setting the cleaning tank in rotational and/or translational motion relative to the pressure tank comprise a hydraulic motor located inside the pressure tank.

For the method, this objective is achieved according to the invention by envisioning that the cleaning tank or tanks is or are set in rotational and/or translational motion relative to the pressure tank via the means located inside the pressure tank for setting the cleaning tank or tanks in motion, without movable shafts that would penetrate the pressure tank, and/or without a magnetic coupling of the cleaning tank.

The invention is based upon the idea of eliminating, on the one hand, the magnetic coupling between the cleaning tank and the drive mechanism, because of the above-described disadvantages, and, on the other hand, on arranging the means for setting the cleaning tank in motion inside the pressure tank in order to avoid the use of movable shafts (rotating shafts) that are costly to seal and penetrate through the pressure tank. To this end, the drive means are positioned inside the pressure tank and, simultaneously, inside and/or preferably outside the cleaning tank.

The means for setting the cleaning tank in motion may include any and all suitable drive mechanisms, such as hydraulic motors or electric motors, or nozzles combined with an impeller wheel. If hydraulic motors are used, additional advantages can result, provided the cleaning fluid is also used as drive medium for the motor.

As a result, in the context of the invention, there may only be non-moving feed-throughs, e.g. feed-throughs for hydraulic fluid if a hydraulic motor is used as the drive mechanism for the cleaning tank, electrical lines if an electric motor is used as the drive mechanism for the cleaning tank, or one or more nozzles directed at an impeller wheel.

The cleaning tank can, for example, be designed as a cleaning cylinder or a cleaning basket.

In a further embodiment of the invention, the at least one supply line for filling the tank with cleaning fluid and/or for emptying the tank can be disconnected before the cleaning tank is set in motion, or it can be wound up while the cleaning tank is moving.

It is noted that if the cleaning device specified in the invention is used in cleaning processes that are not implemented under pressure, the containers obviously do not need to be pressure-tight. This type of embodiment of the cleaning device is implied in the context of the invention. However, cleaning processes that use a cleaning fluid comprising liquefied and/or, above all, supercritical gases, cannot be implemented without pressure.

Contrary to the known state of the art, which provided for the generation of movement of the cleaning tank by way of a magnetic coupling, it is now possible to eliminate the rotary lead-throughs passing through the pressure container for the cleaning tank that were necessary until now. According to the invention, the cleaning tank, which is arranged inside the pressure tank, is now set in motion, and preferably it is rotated. This results in a relative movement between the material being cleaned (substrate) and the cleaning fluid, leading to the desired improvement of the cleaning effect.

Suitable cleaning fluids according to the invention include especially all known liquefiable gases, such as carbon dioxide, dinitrogen monoxide, sulphur hexafluoride, or hydrocarbons, such as methane, ethane, propane, ethene, propene etc., as well as halogenated hydrocarbons, such as trifluoromethane and mixtures of the above-named substances.

With regard to the invention, carbon dioxide has proven to be a particularly well suited fluid because it has certain advantages. Carbon dioxide is non-flammable, non-explosive and large quantities of it are available at low cost since it is an industrial by-product. In comparison to other solvents, carbon dioxide has only a minimal environmental impact, and carbon dioxide is chemically inert. Furthermore, its thermodynamic properties make carbon dioxide a good candidate for use as a cleaning agent.

Preferably, the cleaning process is implemented using liquefied (sub-critical) carbon dioxide. This applies especially for the cleaning of textiles, carpets and the like.

According to the invention, the cleaning process can be performed at all suitable pressures (even above 200 bar) and temperatures.

Advantageously, the cleaning process is implemented at a pressure of less than 100 bar, preferably at between 25 and 80 bar, and most preferably at a pressure of between 30 and 70 bar.

Advantageously, the cleaning process is implemented at a temperature of between −20° C. and +40° C., preferably at a temperature of between −15° C. and +25° C., and most preferably at a temperature of between 0 and +15° C.

Good cleaning results with liquefied carbon dioxide were achieved, for example, at a pressure of between 25 and 75 bar and at a temperature of between −15 and +25° C., in particular at a pressure of between 40 and 50 bar and at a temperature of between +5° C. and +10° C.

Particular advantages with regard to cleaning fluid consumption, and therefore the cost-effectiveness of the cleaning process, result from the fact that the liquefied gas is at least partially re-circulated. Suitable means to accomplish this can be present as part of the cleaning system.

In a favorable embodiment of the cleaning process according to the invention, cleaning intensifiers, such as chemical solvents, are added to the cleaning fluid. Chemical solvents, such as e.g. surface-active agents, HCl, alcohols, anhydrous soaps etc., increase the solvency effectiveness of the liquefied gas used as cleaning fluid.

Adding mechanical scouring agents, such as plastic granulate, steel scrap or slag sand, is also conceivable in order to effect an additional mechanical removal of the surface layers of the substance that is to be dissolved.

Other objects, advantages and novel features of the present invention will become apparent from the following detailed description of the invention when considered in conjunction with the accompanying drawings.

BRIEF DESCRIPTION OF THE DRAWING

The sole FIGURE depicts a cleaning apparatus according to the invention.

DETAILED DESCRIPTION OF THE DRAWING

The cleaning device according to the invention, shown in the FIGURE, is comprised of a tank or pressure tank 1—hereinafter referred to as the pressure tank—and a cleaning tank 2, arranged inside the pressure tank and realized with the ability to be set to perform a rotational and/or translational motion. The material (substrate) to be cleaned is placed inside this cleaning tank. The material to be cleaned can be bulk material, textiles, carpets or similar materials but also industrial components, such as work pieces, machinery components, assembly groups and the like.

Filling and emptying of the cleaning apparatus according to the invention occurs by way of at least one access opening, not shown in the FIGURE, equipped with a seal in order to be able to withstand any cleaning processes implemented with pressure application.

The cleaning fluid is fed into the cleaning apparatus according to the invention via a feed or supply line, not shown in the FIGURE. The cleaning fluid originates, for example, from a storage and/or receiver tank. In accordance with a preferred embodiment of the cleaning apparatus according to the invention, this feed line can be equipped with a coupling, in particular a quick-action stop coupling. Prior to the start of the cleaning process and the movement of the cleaning tank 2 for at least part of the duration of the cleaning process, the desired quantity of cleaning fluid is fed in via the feed line. Subsequently, the feed line is, for example, disconnected.

An advantageous embodiment of the cleaning apparatus according to the invention provides for the feed line to be equipped with a wind-up unit. A wind-up mechanism of this type allows the cleaning tank 2 to execute a specific number of revolutions—limited by the length of the line—in each direction without requiring that the feed line be disconnected. With this embodiment of the invention it is possible to maintain the relative movement between the material being cleaned and the cleaning fluid also during the filling and emptying of the cleaning apparatus according to the invention.

The cleaning tank 2—in accordance with one possible embodiment of the invention—is supported with two rollers 4 and 4' on corresponding roller paths 3 and 3'. The roller paths can now be moved or driven with a drive mechanism, for example, using a hydraulic motor 5, which results in a rotation of the cleaning tank 2. The hydraulic motor 5 drives a gear 8, which in turn sets the cleaning tank 2 to rotate via a gear ring 9 arranged on the circumference of the cleaning tank 2. For this purpose, a drive medium is fed to or directed away from the hydraulic motor 5 via the lines 6 and 7. The passage (feed-throughs) of these lines through the pressure tank 1 are to be realized in correspondence with the application of the cleaning apparatus according to the invention. Suitable drive media for a hydraulic motor 5 of this type include e.g. oil, water or other corresponding special fluids. Reversing the direction of rotation of the hydraulic motor 5 is achieved if the flow direction of the drive medium is reversed. The rotational movement of the cleaning tank 2 achieved in this manner can also be maintained during the filling and emptying of the cleaning apparatus according to the invention.

If a pressure difference exists between the inside area of the pressure tank 1 and the drive medium, the cleaning fluid can also be used as drive medium for the hydraulic motor 5.

In addition to the possibility of supporting the cleaning tank 2 on roller paths 3 and 3', as illustrated in the FIGURE, the tank can also be supported by axially arranged sliding or ball bearings 10 and 10'.

Furthermore, the cleaning tank 2 may be equipped with at least one impeller wheel 13—preferably arranged on its circumference—which is coupled with a drive mechanism, such as at least one nozzle directed at the impeller wheel 13. In this case the impeller wheel is designed as a so-called Pelton turbine. Via a line 11, a drive medium is fed into the pressure tank 1, and is directed at the impeller wheel 13 via at least one nozzle, which is not illustrated in the diagram, such that the impeller wheel, and thus the cleaning tank 2, is set in motion. A reversal of the direction of rotation can be achieved by changing the orientation of the nozzle, or by envisioning multiple nozzles having varying orientations.

To empty the pressure tank 1, the cleaning fluid can be drawn out via a decompression device 14, which also serves to drive the impeller wheel, and via an outlet channel 15.

It is also possible, however, to drive the cleaning tank 2 via an electric motor that acts upon the roller paths 3 and 3' and/or the shafts supported by the bearings 10 and 10'. If the cleaning fluid is an electrically non-conducting medium, a complete pressure coupling of the electric motor is not necessary.

Additional or alternative apparatuses are not represented in the FIGURE that will allow, for example, for movement of the cleaning tank 2 in an axial direction.

With regard to the embodied example of the cleaning apparatus according to the invention shown in the FIGURE, by repeatedly reversing the direction of rotation of the cleaning tank 2 it is possible to realize a wide range of pendulum movements at various speeds.

Corresponding to another advantageous embodiment of the cleaning apparatus according to the invention, the cleaning tank 2 can be equipped with built-in components that influence the movement of the material being cleaned. With built-in components of this type, it is possible, in particular, to achieve a swirling of the cleaning fluid, resulting in an intensification of the cleaning effect of the cleaning fluid.

It is especially advantageous if the cleaning tank 2 is realized as being removable from the pressure tank 1. In this manner, especially in industrial applications of the cleaning apparatus according to the invention, it is possible to ensure quick emptying and refilling [action].

The possible movement types for the cleaning tank 2 can be multiplied by supporting the cleaning tank 2 on cam wheels and/or via correspondingly designed, for example hydraulically driven, lever mechanisms. Embodiments of this type, as well as due to the overlapping of transversal and longitudinal motions, allow for three-dimensional machine movements of the cleaning tank 2, and therefore also of the material being cleaned.

Preferably, the pressure tank 1 is designed as cylindrical, barrel-shaped or spherical. The latter two possibilities are considered particularly favorable in terms of stress, allowing for minimum wall thicknesses for the tanks and/or pressure containers.

The realizations of the invention or of the cleaning apparatus that are depicted in combination in the FIGURE can also be implemented separately. This applies, in particular, with regard to the means for setting the cleaning tank in motion (drive mechanism) that are shown here.

The cleaning apparatus according to the invention allows for the implementation of cleaning processes using the widest variety of pressurized cleaning fluids, such as e.g. liquid or supercritical carbon dioxide; and the required technical complexity is limited. A purposeful and optimized movement of the material being cleaned can now be realized without a rotary feed-through. Furthermore, the eliminating the high-leakage rotary feed-through results in a reduction in the required energy for generating the rotation.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cleaning apparatus, comprising:

a pressure tank with at least one cleaning tank arranged therein for cleaning a substrate;

means for supplying the cleaning apparatus with a cleaning fluid; and means inside the pressure tank for setting the at least one cleaning tank in motion, wherein by these means the at least one cleaning tank is movably arranged relative to the pressure tank in terms of at least one of rotational or translational movement, and wherein said means inside the pressure tank for setting the at least one cleaning tank in motion include one of a hydraulic motor and an electric motor arranged to rotatably drive a member engageable with a part fixed to said cleaning tank.

2. A cleaning apparatus as claimed in claim 1, wherein the at least one cleaning tank is supported by at least one roller path arranged inside the pressure tank.

3. A cleaning apparatus as claimed in claim 2, wherein the means for setting the at least one cleaning tank in motion comprises a drive mechanism that sets at least one roller path in a rotational motion.

4. A cleaning apparatus as claimed in claim 3, wherein the cleaning tank comprises at least one gear ring that is arranged on a circumference of the at least one cleaning tank and that is connected with the drive mechanism.

5. A cleaning apparatus as claimed in claim 1, wherein the at least one cleaning tank is supported by at least one axially arranged sliding or ball bearing inside the pressure tank.

6. A cleaning apparatus as claimed in claim 1, wherein the cleaning tank comprises at least one impeller wheel arranged on a circumference of the at least one cleaning tank and which is coupled with a drive mechanism.

7. A cleaning apparatus as claimed in claim 6, wherein the drive mechanism comprises at least one nozzle that is directed at the impeller wheel.

8. A cleaning apparatus as claimed in claim 1, wherein the means for supplying the cleaning apparatus with a cleaning fluid comprises a feed line.

9. A cleaning apparatus as claimed in claim 8, further comprising a coupling arranged in the feed line.

10. A cleaning apparatus as claimed in claim 9, wherein the coupling is a quick-action stop coupling.

11. A cleaning apparatus as claimed in claim 9, wherein the feed line is equipped with a wind-up unit.

12. A cleaning apparatus as claimed in claim 1, wherein the at least one cleaning tank is equipped with built-in components that influence the movement of the material being cleaned.

13. A cleaning apparatus as claimed in claim 1, wherein the at least one cleaning tank is removable from the pressure tank.

14. The cleaning apparatus of claim 1, wherein said member is a gear.

15. A method for cleaning substrates, comprising:

introducing at least one of a liquefied or supercritical gas as cleaning fluid into at least one cleaning tank that is arranged inside a pressure tank;

cleaning the substrates by moving the at least one cleaning tank in at least one of a rotational or translational motion in relation to the pressure tank during at least part of the cleaning, by means for setting the at least one cleaning tank in motion, arranged inside the pressure tank, said means for setting the at least one cleaning tank in motion being without rotating shafts penetrating through the pressure tank, or without a magnetic coupling of the at least one cleaning tank, wherein said means for setting the at least one cleaning tank in motion include one of a hydraulic motor and an electric motor arranged to drive a gear engageable with a part fixed to said cleaning tank.

16. A method as claimed in claim 15, wherein the cleaning fluid comprises liquefied carbon dioxide.

17. A method as claimed in claim 15, wherein the cleaning is conducted at a pressure level of less than 100 bar.

18. A method as claimed in claim 15, wherein the cleaning is conducted at a pressure level of between 25 and 80 bar.

19. A method as claimed in claim 15, wherein the cleaning is conducted at a pressure level of between 30 and 70 bar.

20. A method as claimed in claim 15, wherein the cleaning is performed at a temperature of between −20° C. and +40° C.

21. A method as claimed in claim 15, wherein the cleaning is performed at a temperature of between −15° C. and +25° C.

22. A method as claimed in claim 15, wherein the cleaning is performed at a temperature of between 0 and +15° C.

23. A method as claimed in claim 15, wherein the cleaning tank is rotated via at least one gear ring that is arranged on the circumference of the at least one cleaning tank and a gear wheel operating in conjunction with the gear ring.

24. A method as claimed in claim 15, wherein the cleaning tank is rotated via at least one impeller wheel arranged on the circumference of the at least one cleaning tank, and via at least one nozzle directed at the impeller wheel.

25. A method as claimed in claim 15, wherein said cleaning is performed without any rotating shafts penetrating through the pressure tank and without a magnetic coupling of the at least one cleaning tank.

26. A cleaning apparatus, comprising:

a pressure tank with at least one cleaning tank therein for cleaning a substrate;

a supply line to feed cleaning fluid into the cleaning tank; and a driving mechanism for setting the at least one cleaning tank in motion, wherein by this driving mechanism the at least one cleaning tank is movably arranged relative to the pressure tank in terms of at least one of rotational or translational movement, and wherein said driving mechanism is a motor arranged to drive a gear and is fully contained within the pressure tank.

27. The cleaning apparatus of claim 26, wherein said cleaning tank is supported by at least one roller path arranged inside the pressure tank.

28. The cleaning apparatus of claim 26, wherein said cleaning tank is supported by at least one axially arranged sliding or ball bearing inside the pressure tank.

29. The cleaning apparatus of claim 26, further comprising a drive mechanism that sets at least one roller path in a rotational motion.

30. The cleaning apparatus of claim 26, wherein the cleaning tank comprises at least one impeller wheel arranged on a circumference of the cleaning tank.

31. The cleaning apparatus of claim 26, further comprising a drive mechanism to set the impeller wheel in motion, wherein said drive mechanism comprises a nozzle.

32. The cleaning apparatus of claim 26, further comprising a coupling arranged in the supply line.

33. The cleaning apparatus of claim 32, wherein the coupling is a quick-action stop coupling.

34. The cleaning apparatus of claim 26, wherein the supply line is equipped with a wind-up unit.

* * * * *